US006989502B1

(12) United States Patent
Lu

(10) Patent No.: US 6,989,502 B1
(45) Date of Patent: Jan. 24, 2006

(54) ACTIVATING ASSEMBLY FOR A POWER SWITCH ASSEMBLY

(76) Inventor: Wen-Feng Lu, 13F-6, No. 201, Minsheng 1st Rd., Sinsing Dist., Kaohsiung (TW)

( * ) Notice: Subject to any disclaimer, the term of this patent is extended or adjusted under 35 U.S.C. 154(b) by 0 days.

(21) Appl. No.: 10/998,620

(22) Filed: Nov. 30, 2004

(51) Int. Cl.
*H01H 23/00* (2006.01)

(52) U.S. Cl. ..... 200/401; 200/50.33

(58) Field of Classification Search ..... 200/400, 200/401, 500, 501, 1 R, 17 R, 50.32–50.35, 200/330–332
See application file for complete search history.

(56) References Cited

U.S. PATENT DOCUMENTS 2,846,621 A * 8/1958 Coggeshall et al. ..... 200/401
4,181,838 A * 1/1980 Neuser et al. ..... 200/573
6,534,737 B1 * 3/2003 Rademacher et al. ..... 200/401
6,812,423 B1 * 11/2004 Rodgers et al. ..... 200/400

* cited by examiner

*Primary Examiner*—Marina Fishman
(74) *Attorney, Agent, or Firm*—Rosenberg, Klein & Lee

(57) ABSTRACT

An activating device for a switch assembly includes a control panel having a guiding track defined therein, a first arm pivotally connected to the control panel for connection to the first switch, a second arm pivotally connected to the control panel for connection to the second switch, a sliding block slidably received in the guiding track such that the first switch and the second switch are selectively switched on/off; a push rod pivotally received in the sliding block to alternately engage with the first arm and the second arm such that the first switch and the second switch are selectively switched off/on and a driving device to drive the sliding block to move in both the first direction and the second direction.

20 Claims, 12 Drawing Sheets

ACTIVATING ASSEMBLY FOR A POWER SWITCH ASSEMBLY

BACKGROUND OF THE INVENTION

1. Field of the Invention

The present invention relates to an activating assembly, and more particularly to the activating assembly for an automatic power switch to switch to a backup power when the normal power supply fails.

2. Description of Related Art

In a large building, there are normally two sets of power supply, one is using the main power from the power plant and the other is using the generator prepared by the building itself. That is, when the power supply from the power plant fails, the operator in the building is able to switch to backup power from the generator.

With reference to FIGS. 12 and 13, a conventional power switch (20') is shown and has a base (21), a first switch (22) having a first control key (221) integrally formed with the first switch (22), a second switch (23) spaced apart from the first switch (22) and having a second control key (231) integrally formed with the second switch (23), a lever (24) pivotal relative to the base (21), a control disk (25) having multiple positioning bars (251) and multiple first sliding blocks (252) slidably mounted on the positioning bars (251) and integrally formed with the first control key (221) and multiple second sliding blocks (253) slidably mounted on the positioning bars (251) and integrally formed with the second control key (231), a first gear (26) rotatably mounted on top of the positioning bars (251) and having a first guiding rod (A) extending downward to correspond to and connect to the first guiding rod (221) of the first switch (22) and a second gear (27) rotatably mounted on top of the positioning bars (251) and having a second guiding rod (A') extending downward to correspond to and connect to the second guiding rod (231) of the second switch (23). It is noted that the first gear (26) is provided with a first V shaped recess (B) defined in a rear face of the first gear (26) to receive therein the first guiding rod (A). The second gear (27) is provided with a second V shaped recess (B') defined in a rear face of the second gear (27) to receive therein the second guiding rod (A'). A driving gear (28) is sandwiched between and mated with the first gear (26) and the second gear (27). A motor (291) is connected to the driving gear (28). That is, the driving gear (28) is able to be rotated directly by the motor (291). Further, the motor (291) is provided with a handle (292) extending out of the power switch (20) for manual drive of the movement of the driving gear (28).

When the conventional power switch is in process, the motor (291) is able to drive the driving gear (28) to rotate, which in turn drives the first gear (26) and the second gear (27) to rotate in the same orientation. However, due to position difference between the first V shaped recess (B) and the second V shaped recess (B'), the rotation of the first gear (26) and the second gear (27) will then drive the first switch (22) and the second switch (23) to move to different positions. That is, when the first switch (22) is switched open, the second switch (23) is switched close and vice versa. Furthermore, when the power supply to activate the motor (291) fails, the operator is able to use the handle (292) of the motor (291) to drive the driving gear (28) to rotate.

Although the conventional power switch is able to accomplish the desired goal, the structure thereof is complex and thus manufacture cost is high.

To overcome the shortcomings, the present invention tends to provide an improved automatic power switch to mitigate the aforementioned problems.

SUMMARY OF THE INVENTION

The primary objective of the present invention is to provide an improved activating assembly for an automatic power switch to automatically switch from one power source to another power source.

Other objects, advantages and novel features of the invention will become more apparent from the following detailed description when taken in conjunction with the accompanying drawings.

DETAILED DESCRIPTION OF THE PREFERRED EMBODIMENT

Figure 1:
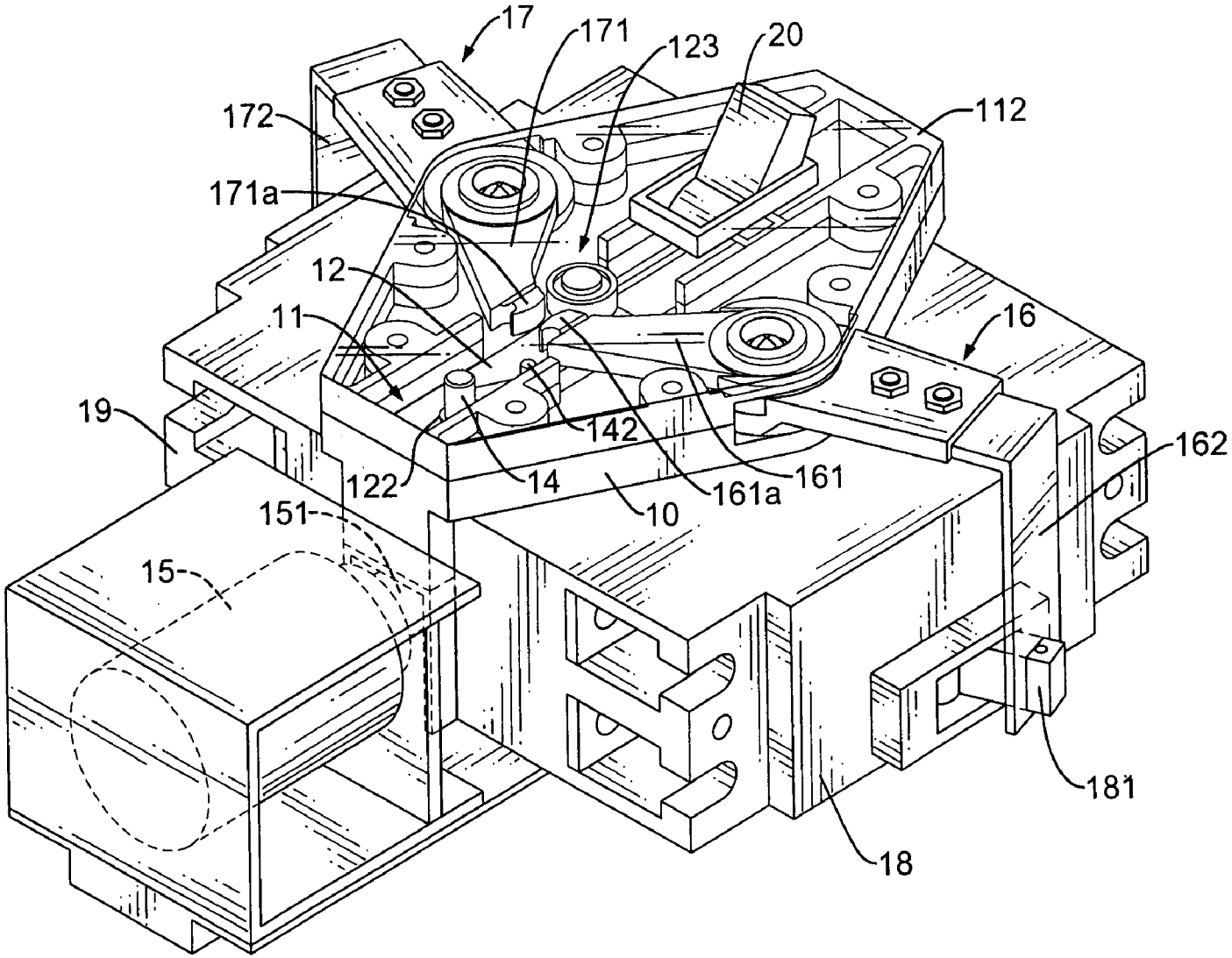
FIG. 1 is a perspective view of the activating assembly for the automatic power switch of the present invention.

With reference to FIG. 1, the activating assembly for an automatic power switch in accordance with the present invention includes a control panel (10) with a guiding track (11) defined on a top face of the control panel (10), a sliding block (12) slidably received in the guiding track (11), a biasing element (13) received inside the sliding block (12), a push rod (14) pivotally and movably mounted in the guiding track (11), a driving device (15) mounted on a side of the control panel (10), a first arm (16) pivotally connected to the control panel (10) and a second arm (17) pivotally connected to the control panel (10) and being opposite to the first arm (16). The fist arm (16) is able to move in a first sectorial trajectory and the second arm (17) is able to move in a second sectorial trajectory bisecting the first sectorial trajectory. Further, a switch assembly having a first switch (18) and a second switch (19) is operably connected to the activating assembly of the present invention. The switch assembly is connected to two power supply sets, i.e. the power supply from the power plant and the power supply from a backup generator (both not shown).

Figure 2:
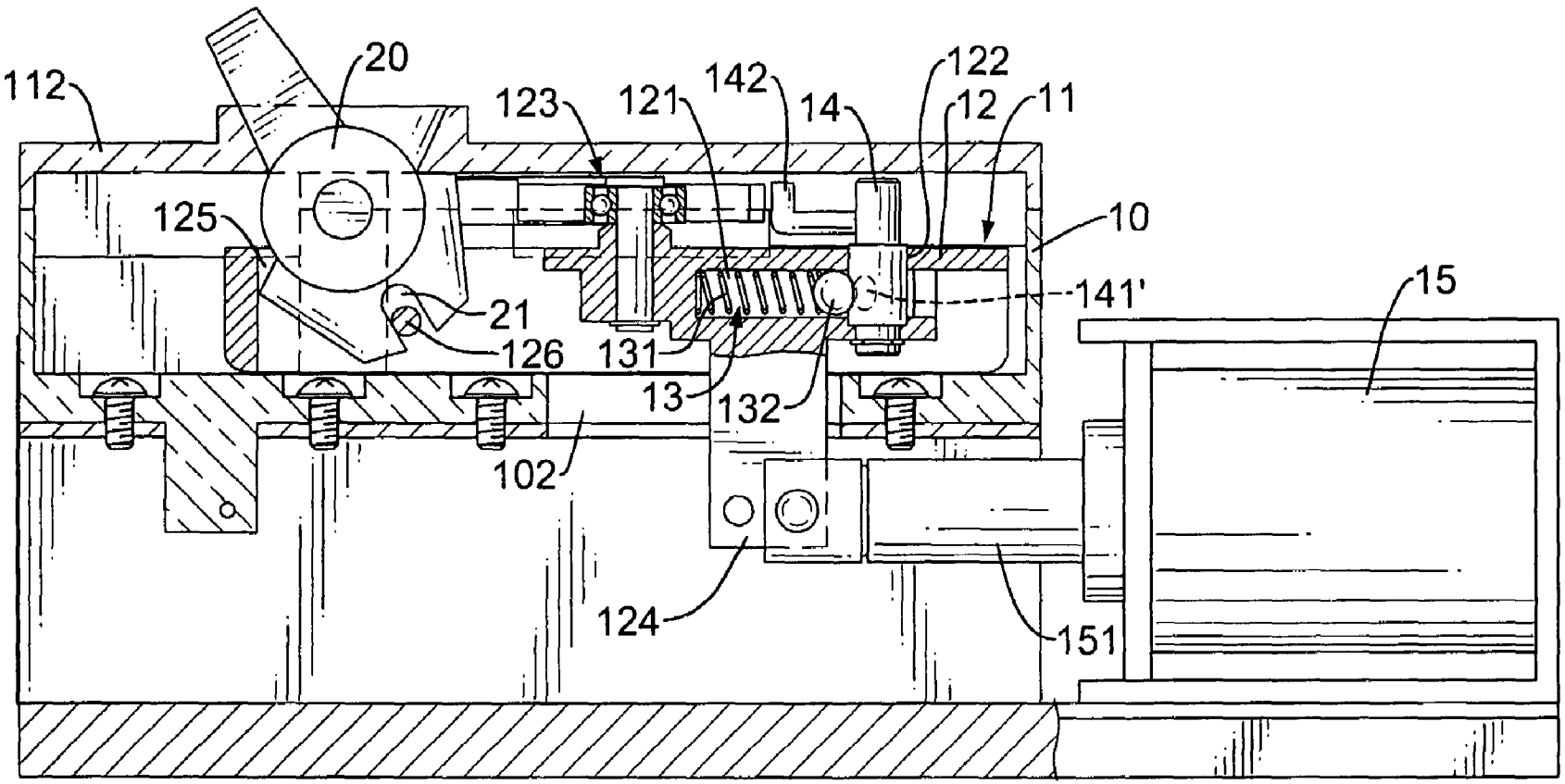
FIG. 2 is a schematic partially cross sectioned view showing the inner structure of the activating assembly for the automatic power switch of the present invention.

With reference to FIG. 2, it is noted that a cap (112) is provided on top of the control panel (10) and has a handle hole (1121) defined through the cap (12). The sliding block (12) is further provided with a slot (121) defined to correspond to and receive therein the biasing element (13), a hole (122) defined in the sliding block (12) to communicate with the slot (121) so as to receive therein the push rod (14), an engagement block (123) formed on a mediate portion of the sliding block (12), an extension (124) formed to extend through a path (102) defined in the control panel (10) to fixedly connect to a driving shaft (151) which is extendably connected to the driving device (15) and a positioning hole (125) defined in a front portion of the sliding block (12) to communicate with the handle hole (1121) of the cap (12) so as to securely receive therein a positioning rod (126) which is extended from a side face defining the positioning hole (125). The biasing element (13) is received in the slot (121) and composed of a spring (131) and a ball (132) abutting a free end of the spring (131). The push rod (14) is inserted into and pivotally received in the hole (122).

Figure 3:
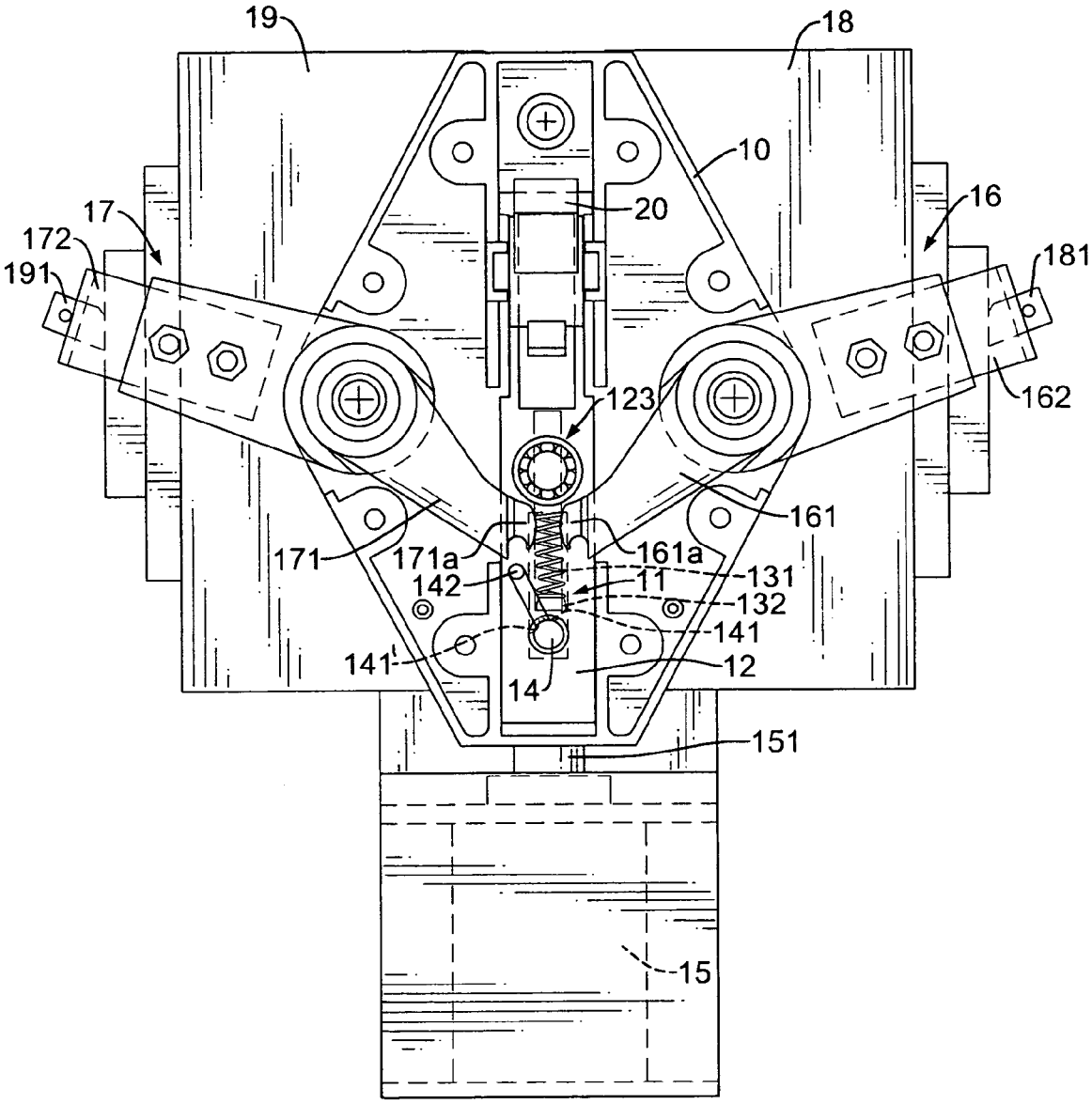
FIG. 3 is a top plan view showing the interrelationship between the two pivotal arms and the push rod.

With reference to FIG. 3, it is noted that the push rod (14) has a right positioning recess (141) and a left positioning recess (141') both peripherally defined in an outer periphery of the push rod (14) to alternately correspond to the ball (132) and a hook (142) extending from the outer periphery of the push rod (14) such that when the ball (132) is received in the right positioning recess (141), the hook (142) is swung to the right and when the ball (132) is received in the left positioning recess (141'), the hook (142) is swung to the left. The first arm (16) is pivotally mounted on the control panel (10) and is composed of an extension portion (161) having a first recess (161*a*) defined in an outer periphery of a free end of the extension portion (161) to correspond to the hook (142) of the push rod (14) and a connecting portion (162) fixedly connected to the extension portion (161). The second arm (17) is also pivotally mounted on the control panel (10) and is composed of an extension portion (171) having a second recess (171*a*) defined in an outer periphery of a free end of the extension portion (171) to correspond to the hook (142) of the push rod (14) and a connecting portion (172) fixedly connected to the extension portion (171) of the second arm (17).

The first switch (18) has a first key (181) pivotally connected to the first switch (18) and the second switch (19) has a second key (191) pivotally connected to the second switch (19). A handle (20) is pivotally received in the handle hole (1121) and has a cutout (21) (as shown in FIG. 2) defined in an outer periphery of the handle (20) to correspond to and receive therein the positioning rod (26).

Referring to FIG. 2, when the activating assembly of the present invention is assembled, it is noted that after the sliding block (12) is received in the guiding track (11) with the extension (124) of the sliding block (12) securely connected to the driving shaft (151) of the driving device (15), the ball (132) of the biasing element (13) is abutted to the push rod (14) which is pivotally received in the hole (122). Therefore, movement of the sliding block (12) by the driving shaft (151) is able to drive the push rod (14) to move accordingly. However, due to the abutment of the biasing element (13) in the slot (121) to the push rod (14), the hook (142) is able to swing to the right or to the left depending which of the two positioning recesses (141, 141') the ball (132) is received.

Figure 4:
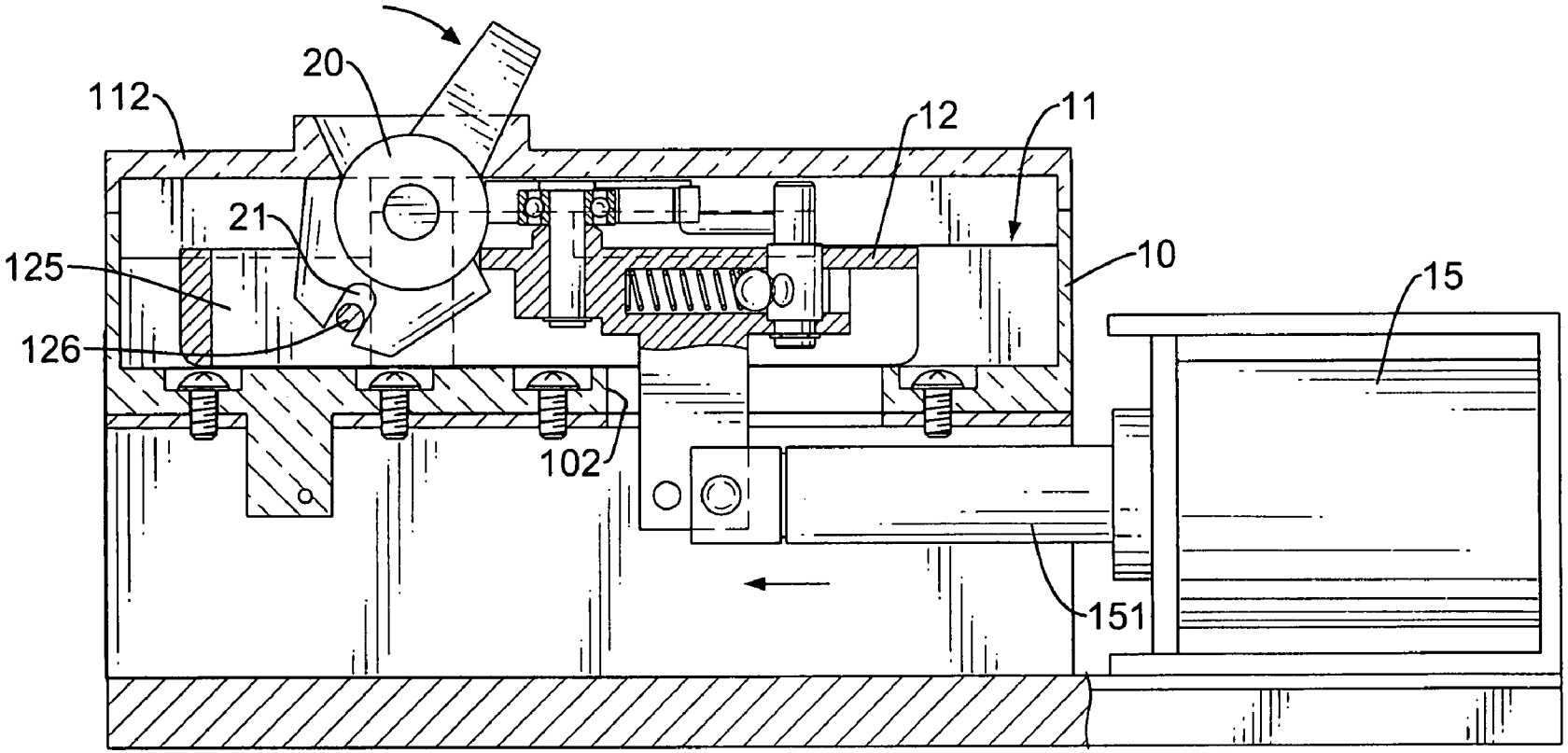
FIG. 4 is a schematic view showing the activation of the driving device or the handle will drive the sliding block to move.

With reference to FIG. 4, when the driving shaft (151) of the driving device (15) drives the sliding block (12) to move or the handle (20) is manually moved to accordingly move the sliding block (12) in the guiding track (11), the sliding block (12) is able to move within the path (102) of the control panel (10).

Figure 5:
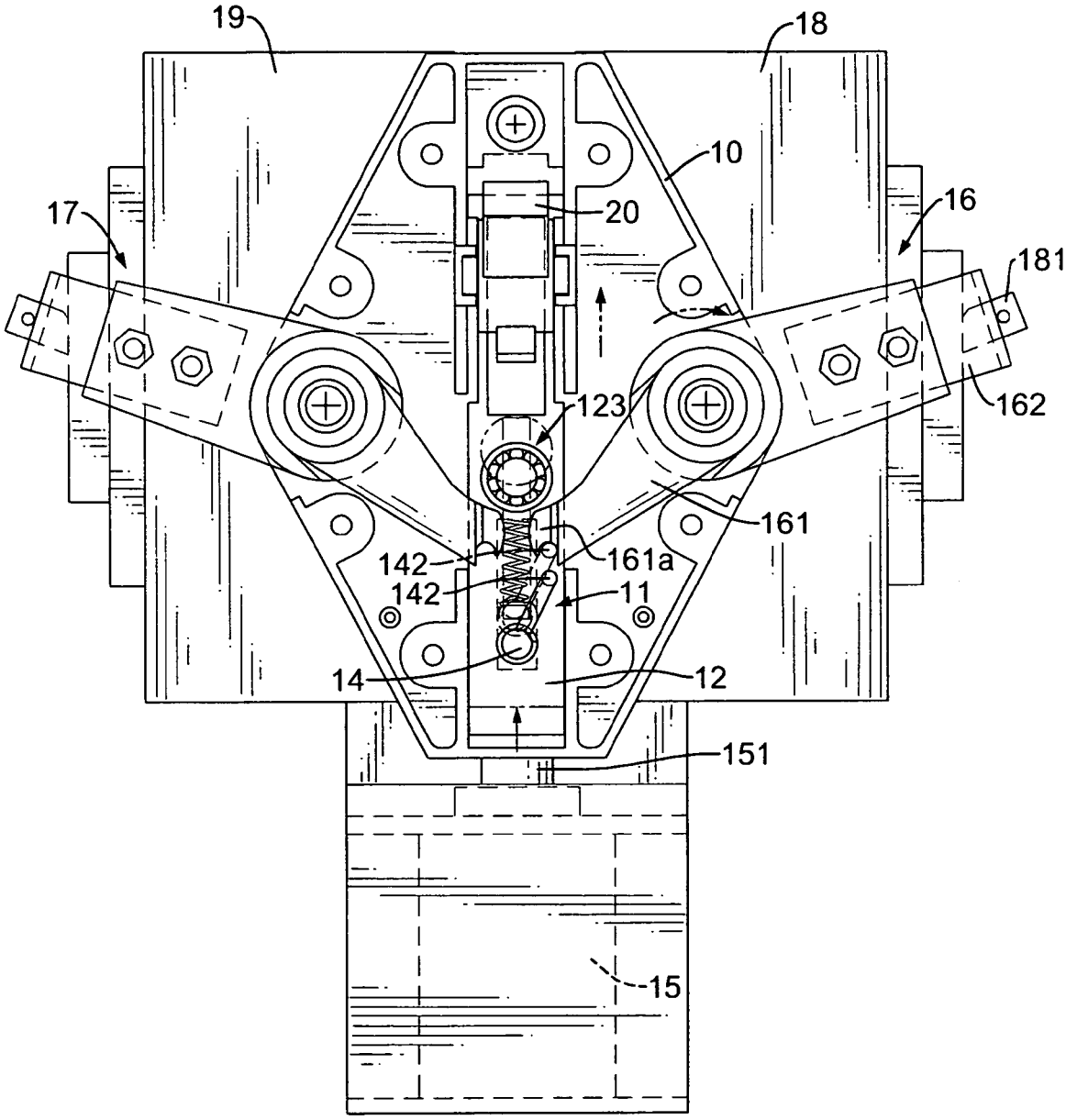
FIG. 5 is a top plan view in correspondence to FIG. 4.
Figure 6:
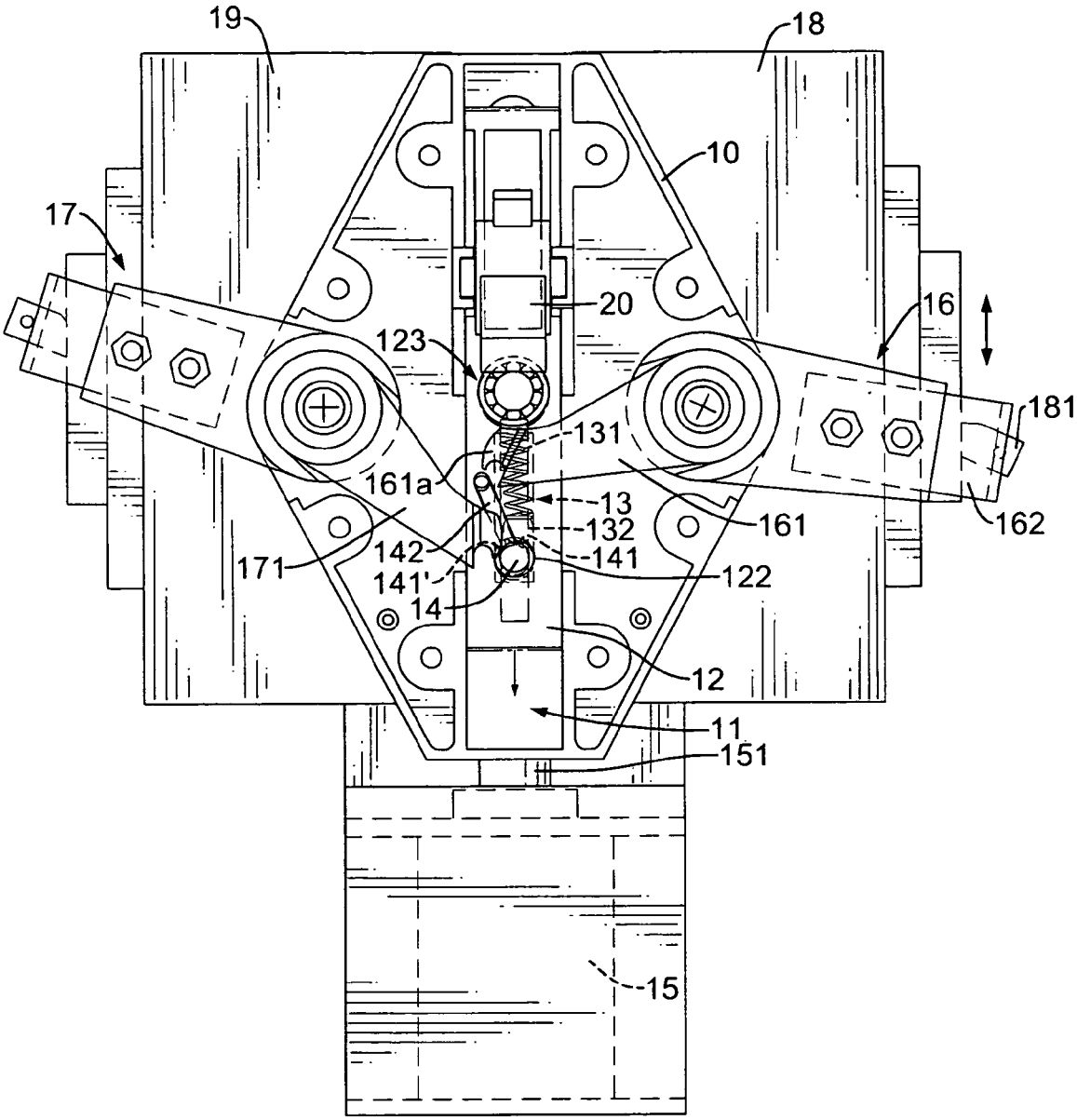
FIG. 6 is a schematic top plan view showing the downward movement of the sliding block.

With reference to FIGS. 5 and 6, before the driving device (15) is actuated, the push rod (14) is previously determined to swing to the right, whereby the movement of the sliding block (12) will facilitate the hook (142) to be received in the first recess (161*a*) of the extension portion (161) of the first arm (16). While the sliding block (12) is continuously moved by the driving shaft (151), the first arm (16) is driven to pivot. The pivotal movement of the first arm (16) will drive the connecting portion (162) to move accordingly. Therefore, the first key (181) of the first switch (18) is driven to move in an orientation opposite to that of the extension portion (161). Eventually, the first switch (18) is ON. It is noted that during the forward movement of the sliding block (12), the hook (142) of the push rod (14) will gradually escape from the first recess (161*a*) of the extension portion (161) and finally be swung to the left. In the meantime the ball (132) of the biasing element (13) is received in the left receiving recess (141') to maintain the push rod (14) swung to the left. Thereafter, the first switch (18) is ON and that the normal power supply is able to pass through the switch assembly via the first switch (18). In addition, the second switch (19) is maintained OFF.

When there is a power outage, the driving device (15) (or the handle (20) is manually moved) is activated to drive the sliding block (12) to move. Because the push rod (14) is previously swung to the left and the biasing element (13) is applied to maintain the hook (142) toward the left, the rearward movement of the sliding block (12) will force the engagement block (123) to engage and drive the first arm (16) to move counterclockwisely such that the first key (181) is moved accordingly. Thus the first switch (18) is switched off. While the sliding block (12) is move rearward, the hook (142) of the push rod (14) engages with the outer periphery of the extension portion (171) of the second arm (17). The engagement of the hook (142) with the outer periphery of the extension portion (171) of the second arm (17) while the sliding block (12) is moving rearward is not able to swing the hook (142) back to the right. That is, after the hook (142) passes over the extension portion (171) of the second arm (17), the push rod (14) is still kept to the left. At a situation like this, both the first switch (18) and the second switch (19) are switched off.

Figure 7:
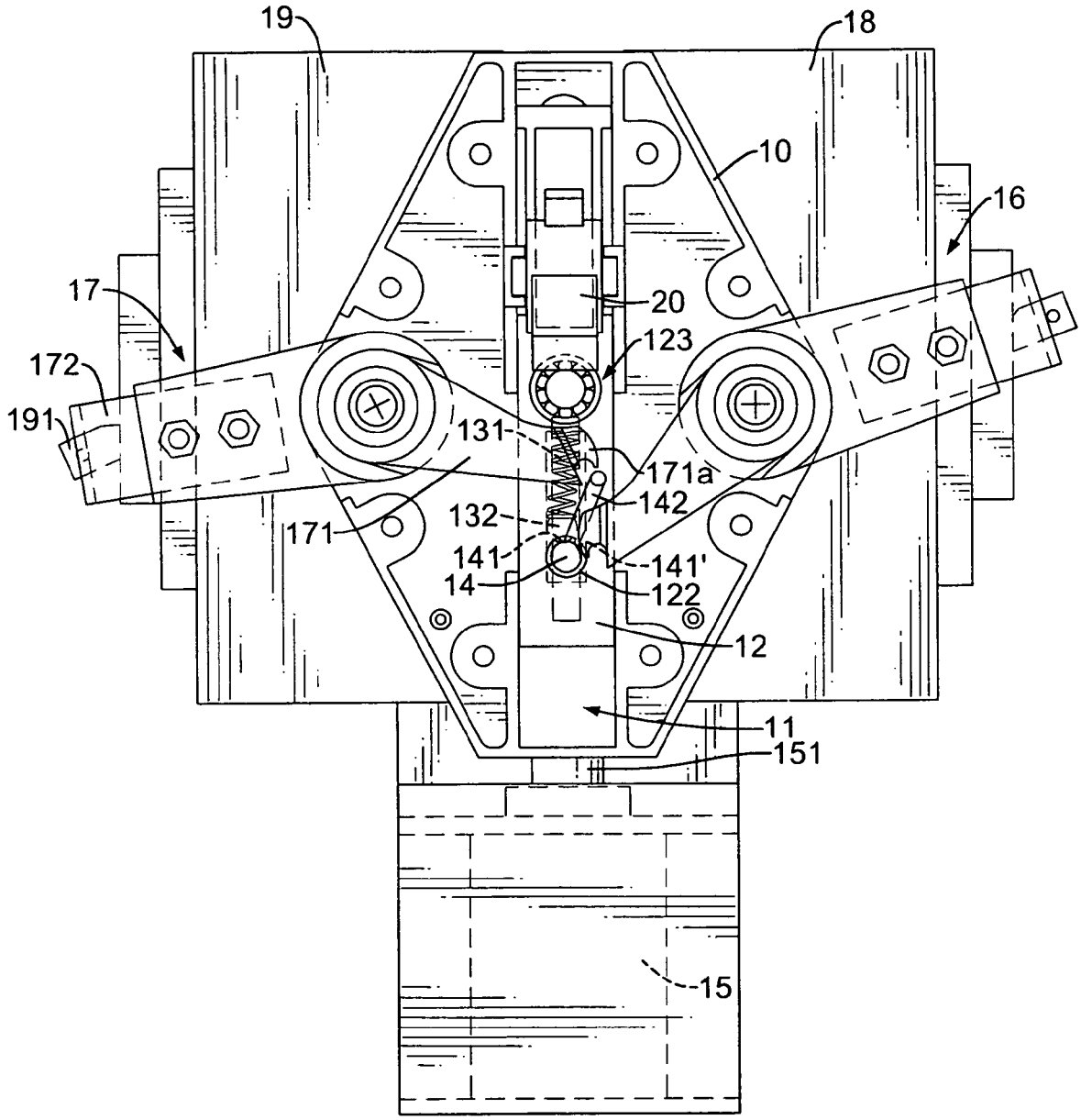
FIG. 7 is a top plan view showing that when the second switch is activated/deactivated, the first switch is deactivated/activated.

However, with reference to FIG. 7, when the driving device (15) is actuated to move the sliding block (12) forward again, the hook (142) is received in the second recess (171*a*) of the second arm (17). Thus the continuous movement of the sliding block (12) drives the second arm (17) to pivot counterclockwisely. Therefore, the second key (191) of the second switch (19) is switched on. After the hook (142) is received in the second recess (171*a*), the continuous movement of the sliding block (12) will eventually swing the hook (142) to the right. That is, the ball (132) of the biasing element (13) will be received in the right receiving recess (141) of the push rod (14). Meanwhile, the switch assembly allows the power from the backup power source to be conducted through the switch assembly. The activating assembly of the present invention assures that the first switch (18) and the second switch (19) are not simultaneously ON so that the power supply from either of the two power sources will not endanger the circuit of the building.

The driving device (15) in this embodiment may be any type of motor, an electromagnetic valve or the equivalents thereof. The ball (132) of the biasing element (13) may be replaced with an element such as a pin or the like.

After explaining the embodiment of the present invention, a series of schematic views are provided to explain the principle of the present invention.

Figure 8:
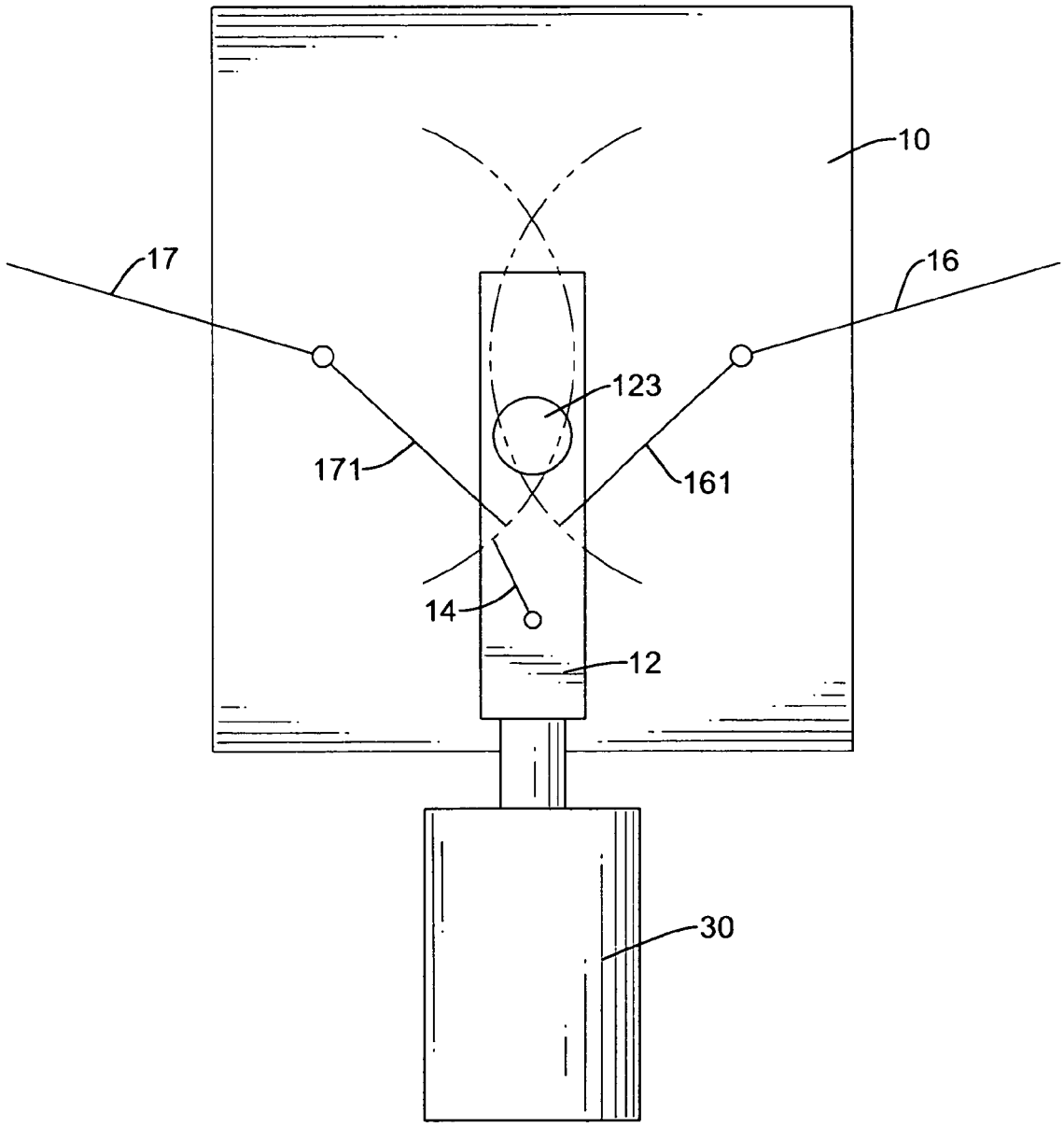
FIG. 8 is a schematic view showing the principle of the design of the present invention.

With reference to FIG. 8, it is noted that the driving device (30) is mounted on a side of the control panel (10). The control panel (10) is provided with a sliding block (12) movable relative to the control panel (10) and having an engagement block (123) mounted on top of the sliding block (12). A first arm (16) is pivotally connected to the control panel (10) and has an extension portion (161) extending out of the first arm (16) to alternately engage with a push rod (14) which is pivotally mounted on the sliding block (12). A second arm (17) is pivotally connected to the control panel (10) and has an extension (171) extending out of the second arm (17) to alternately engage with the push rod (14).

Figure 9:
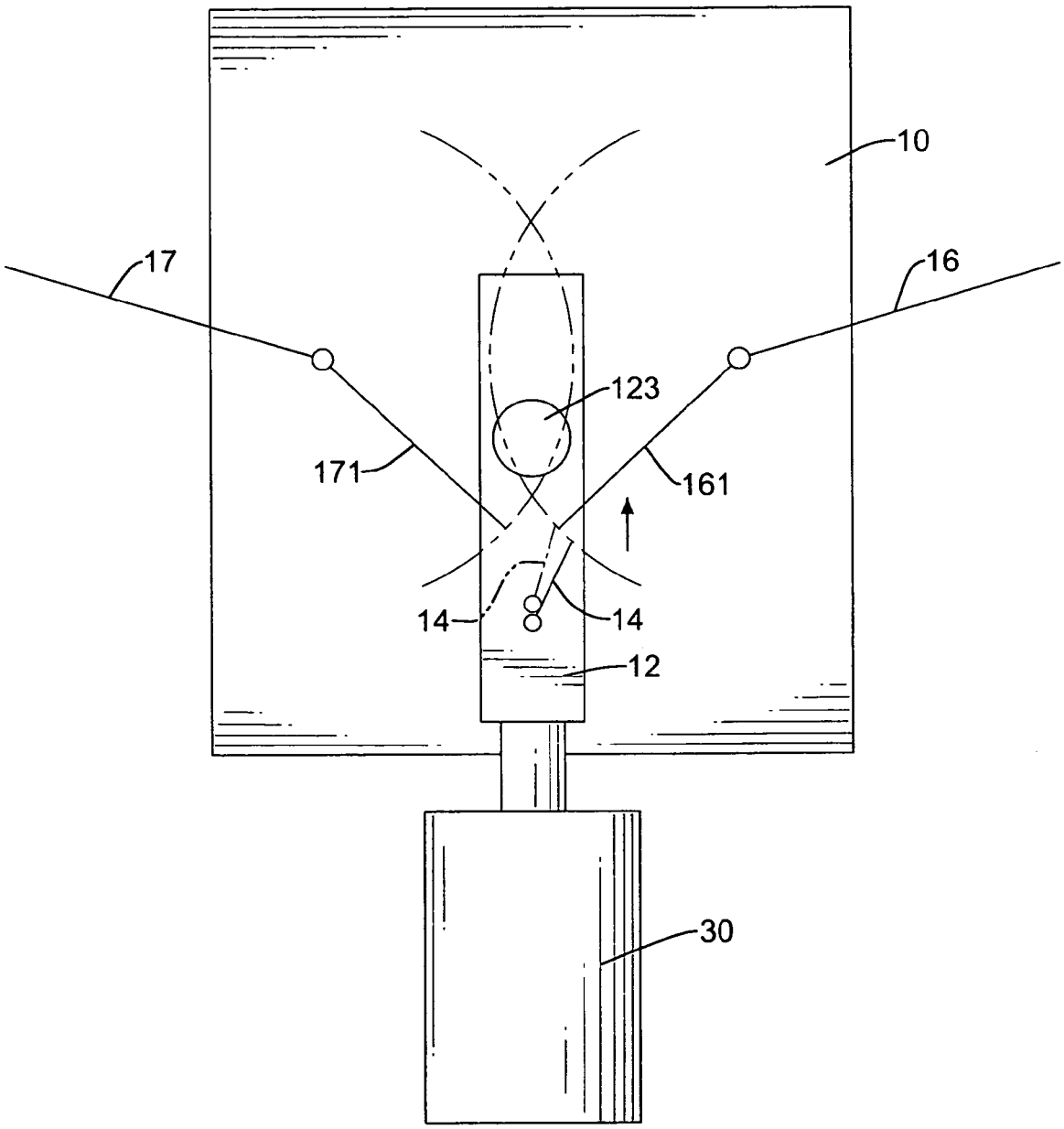
FIG. 9 is a schematic view showing that the sliding block is pushed upward while the push rod is biased to the first arm.
Figure 10:
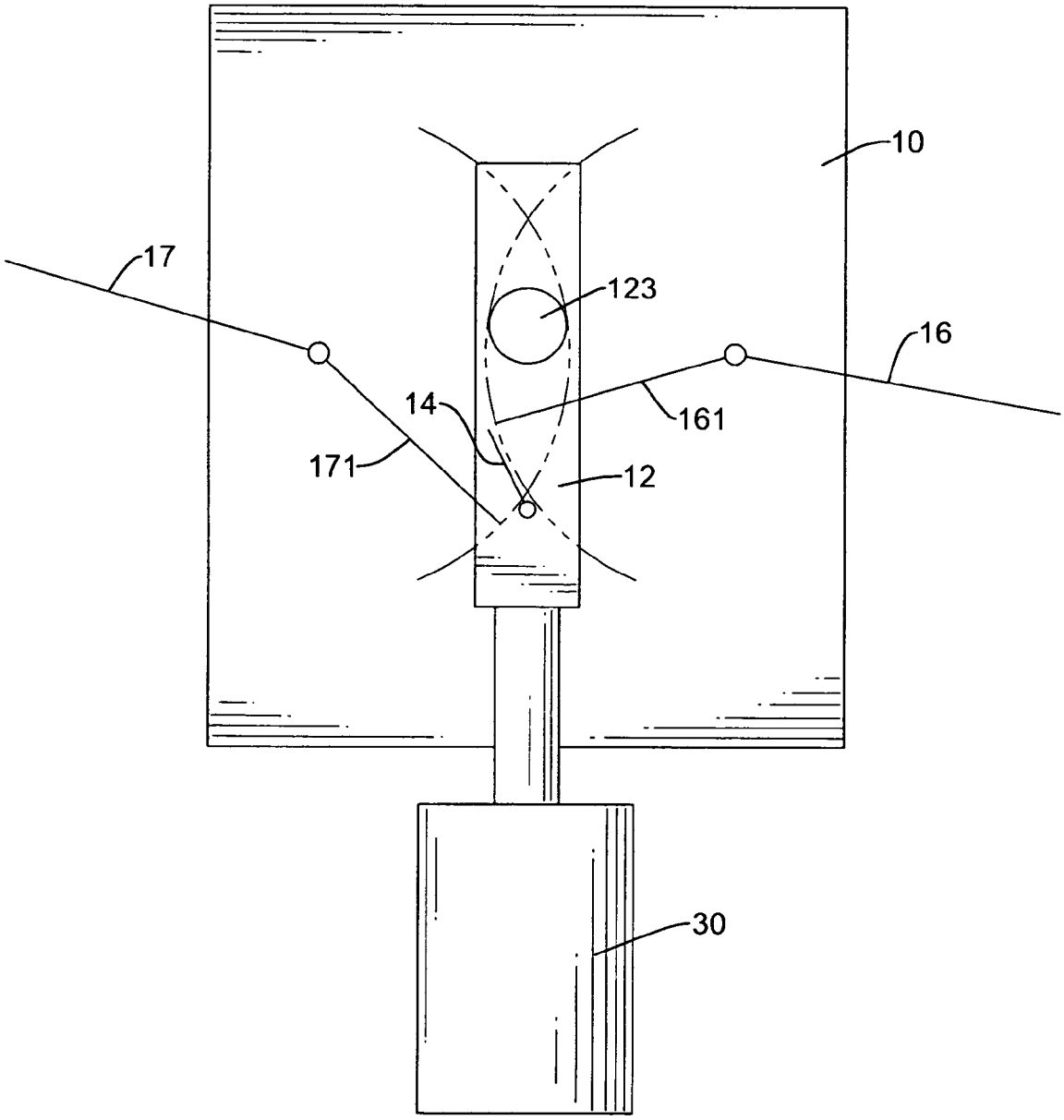
FIG. 10 is a schematic view showing that the sliding block is driven to move downward and the first arm is moved to its original position.
Figure 11:
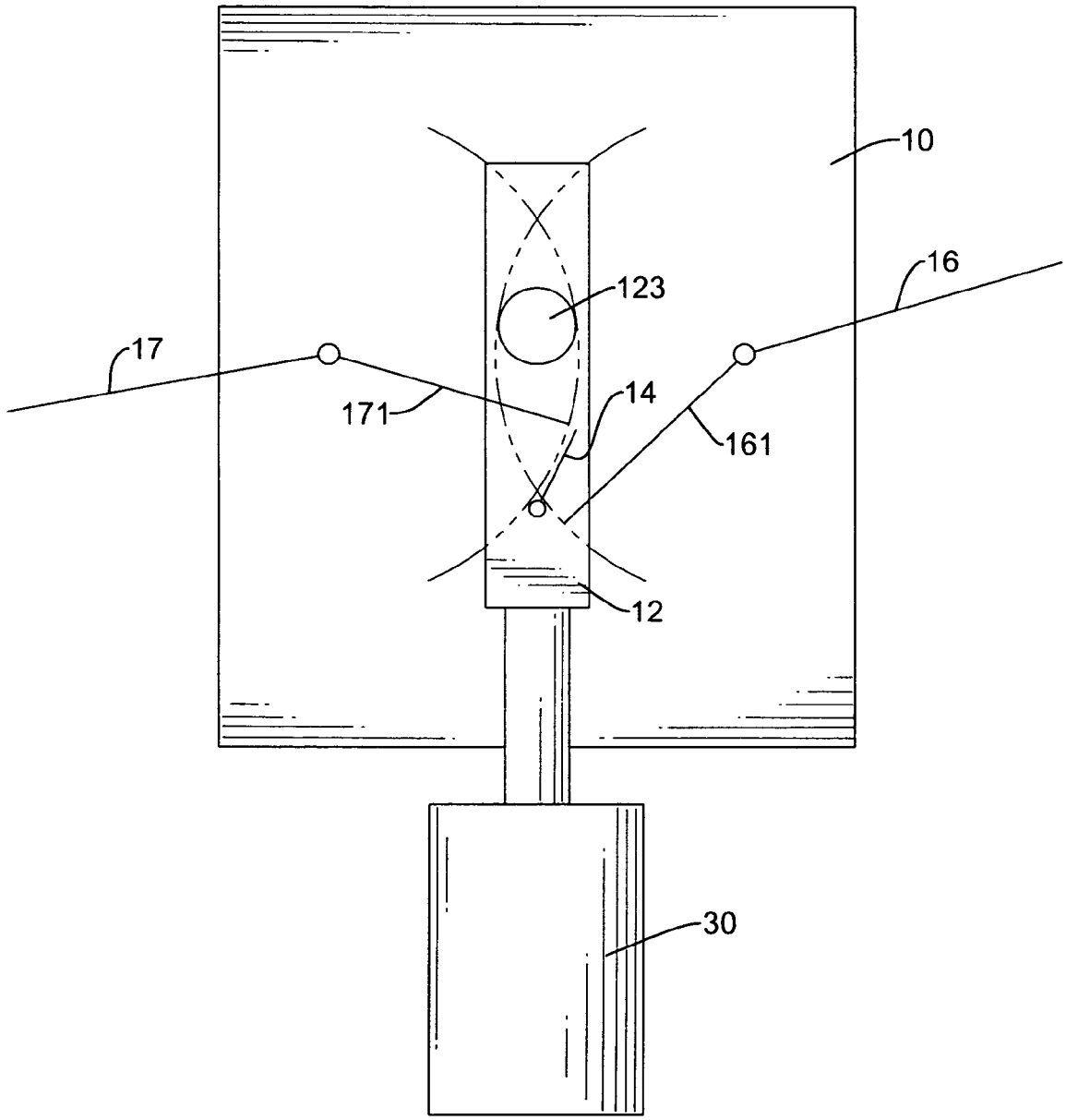
FIG. 11 is a schematic view showing that while both the first switch and the second switch are off, the upward movement of the sliding block is able to activate the second switch by the movement of the second arm.
Figure 12:
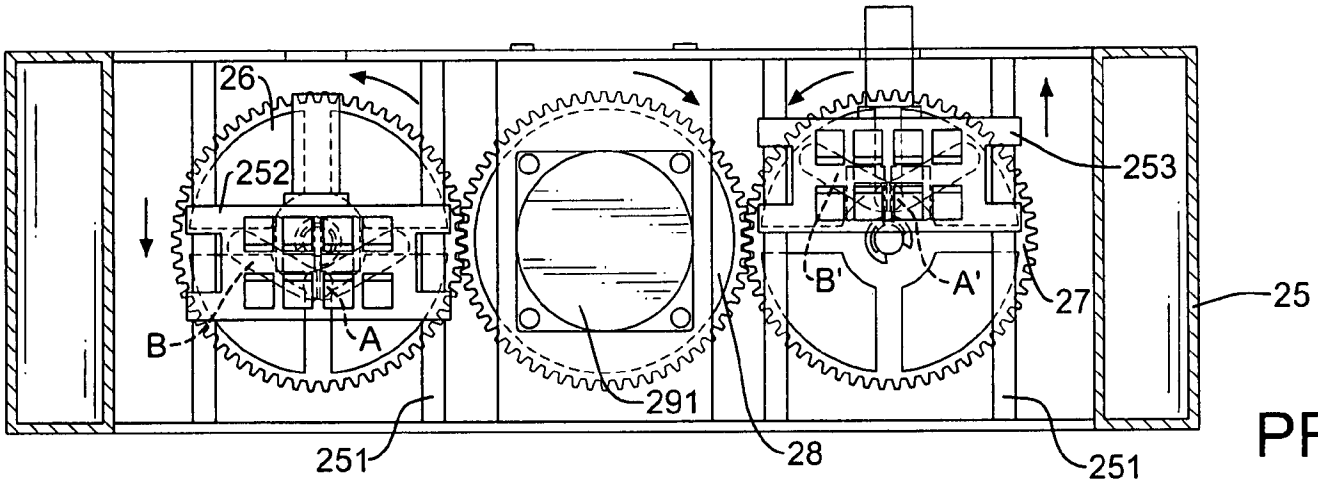
FIG.12 PRIOR ART
FIG. 12 is a schematic top plan view showing a conventional power switch.
Figure 13:
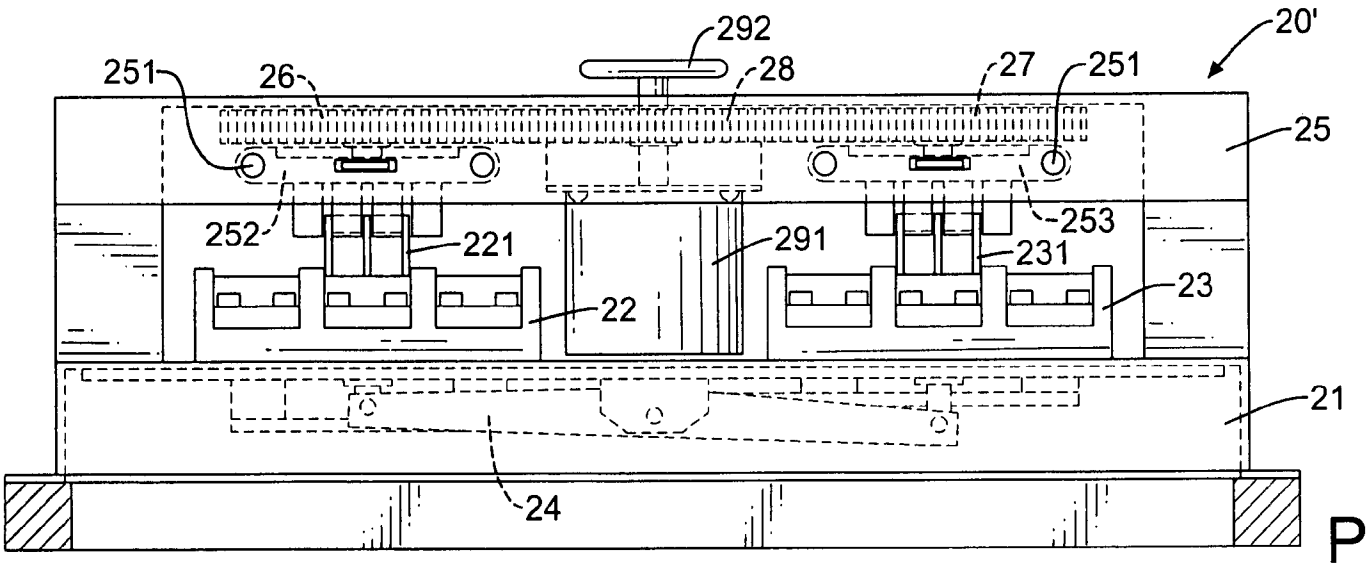
FIG.13 PRIOR ART
FIG. 13 is a schematic side plan view showing the conventional power switch.

With reference to FIGS. 9, 10 and 11, it is noted that when the push rod (14) is positioned to the right relative to the sliding block (12), the movement of the sliding block (12) will drive the push rod (14) to engage with the extension portion (161) of the first arm (16) so as to pivot the first arm (16) clockwisely so as to turn the first switch (not shown). The continuous movement of the sliding block (12) will allow the push rod (14) to disengage with the extension (161) of the first arm (16) and eventually the push rod (14) is swung to the left relative to the sliding block (12). However, when there is a power shortage or power outage, the driving device (30) is activated to drive the sliding block (12) rearward. Because before the rearward movement of the sliding block (12), the push rod (14) is swung to the left, the engagement block (123) will engage with the first arm (16) to pivot the first arm (16) counterclockwisely such that the first switch is turned off while maintaining the push rod (14) swung to the left.

If the sliding block (12) is forwardly moved by the driving device (15) again, the push rod (14) will engage with the extension portion (171) of the second arm (17) to drive the second arm (17) to pivot counterclockwisely. Thus the second switch is turned on to allow the electricity from the backup power supply to be conducted through the switch assembly. Again, the continuous movement of the sliding block (12) will eventually deviate the push rod (14) to the right for preparation of the next process, i.e. the normal power supply.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An activating device for a switch assembly having a first switch and a second switch to respectively control power flow from different power sources, the activating assembly comprising:

a control panel having a guiding track defined therein;

a first arm pivotally connected to the control panel for connection to the first switch, wherein the first arm moves in a first sectorial trajectory;

a second arm pivotally connected to the control panel for connection to the second switch, wherein the second arm moves in a second sectorial trajectory bisecting the first sectorial trajectory;

a sliding block slidably received in the guiding track and having an engagement block formed on a median portion of the sliding block to alternately engage with the first arm and the second arm when the sliding block is moving in a first direction relative to the control panel such that the first switch and the second switch are alternately switched off;

a push rod pivotally received in the sliding block to alternately engage with the first arm and the second arm when the sliding block is moving in a second direction relative to the control panel such that the first switch and the second switch are selectively switched off/on; and a driving device having a driving shaft securely connected to the sliding block to drive the sliding block to move in both the first direction and the second direction.

2. The activating device as claimed in claim 1, wherein the sliding block further has a hole defined to pivotally receive therein the push rod and an extension extending from a bottom of the sliding block to securely connect to the driving shaft.

3. The activating device as claimed in claim 1 further having a biasing element received in a slot which is defined in the sliding block, the biasing element having a spring and a ball sandwiched between an end of the spring and an outer periphery of the push rod (14) to maintain an orientation of the push rod (14).

4. The activating device as claimed in claim 2 further having a biasing element received in a slot which is defined in the sliding block, the biasing element having a spring and a ball sandwiched between an end of the spring and an outer periphery of the push rod to maintain an orientation of the push rod.

5. The activating device as claimed in claim 4, wherein the push rod (14) further has a right receiving recess (141) and a left receiving recess (141') respectively corresponding to the ball (132) of the biasing element (13) so that the ball (132) is selectively received in the right receiving recess (141) and the left receiving recess (141') to allow the push rod (14) to swing to the right and the left respectively.

6. The activating device as claimed in claim 1, wherein the push rod further has a hook (142) integrally formed with and extending out of the push rod (14) to selectively engage with the first arm (16) and the second arm (17) so as to alternately drive the first arm and the second to pivot in different directions.

7. The activating device as claimed in claim 2, wherein the push rod further has a hook integrally formed with and extending out of the push rod to selectively engage with the first arm and the second arm so as to alternately drive the first arm and the second to pivot in different directions.

8. The activating device as claimed in claim 3, wherein the push rod further has a hook integrally formed with and extending out of the push rod to selectively engage with the first arm and the second arm so as to alternately drive the first arm and the second to pivot in different directions.

9. The activating device as claimed in claim 4, wherein the push rod further has a hook integrally formed with and extending out of the push rod to selectively engage with the first arm and the second arm so as to alternately drive the first arm and the second to pivot in different directions.

10. The activating device as claimed in claim 5, wherein the push rod further has a hook integrally formed with and extending out of the push rod to selectively engage with the first arm and the second arm so as to alternately drive the first arm and the second to pivot in different directions.

11. The activating device as claimed in claim 10 further comprising a handle (20) pivotally received in the control panel (10) to drive the sliding block (12) to move.

12. The activating device as claimed in claim 11, wherein the sliding block (12) has a positioning hole (125) and a positioning rod (126) formed on a side wall defining the positioning hole (125) and the handle (20) has a cutout (21) defined in an outer periphery of the handle (20) to correspond to and receive therein the positioning rod (126) such that the pivotal movement of the handle (20) is able to drive the sliding block (12) to move.

13. A method for activating/deactivating a switch assembly having a first switch and a second switch for control of power flow from different power sources, the method comprising:

preparing a control panel which has a guiding track defined therein;

moving a sliding block slidably in the guiding track;

alternately pivoting a first arm in connection with the first switch and a second arm in connection with the second switch to activate/deactivate the first switch and the second switch.

14. The method as claimed in claim 13, wherein the sliding block has an engagement block formed on top of the sliding block to alternately pivot the first arm and the second arm so as to change status of the first switch and the second switch.

15. The method as claimed in claim 14, wherein the sliding block further has a hole defined to pivotally receive therein the push rod and an extension extending from a bottom of the sliding block to securely connect to the driving shaft.

16. The method as claimed in claim 15, wherein the sliding block further has a slot defined therein to receive therein a biasing element, the biasing element has a spring and a ball sandwiched between an end of the spring and an outer periphery of the push rod to maintain an orientation of the push rod.

17. The method as claimed in claim 16, wherein the push rod further has a right receiving recess and a left receiving recess respectively corresponding to the ball of the biasing element so that the ball is selectively received in the right receiving recess and the left receiving recess to allow the push rod to swing to the right and the left respectively.

18. The method as claimed in claim 17, wherein the push rod further has a hook integrally formed with and extending out of the push rod to selectively engage with the first arm and the second arm so as to alternately drive the first arm or the second to pivot in different directions.

19. The method as claimed in claim 18, wherein a handle is pivotally received in the control panel to drive the sliding block to move.

20. The method as claimed in claim 19, wherein the sliding block has a positioning hole and a positioning rod formed on a side wall of defining the positioning hole and the handle has a cutout defined in an outer periphery of the handle to correspond to and receive therein the positioning rod such that the pivotal movement of the handle is able to drive the sliding block to move.

* * * * *